United States Patent [19]

Buse

[11] Patent Number: 4,871,301

[45] Date of Patent: Oct. 3, 1989

[54] CENTRIFUGAL PUMP BEARING ARRANGEMENT

[75] Inventor: Frederic W. Buse, Allentown, Pa.

[73] Assignee: Ingersoll-Rand Company, Woodcliff Lake, N.J.

[21] Appl. No.: 161,585

[22] Filed: Feb. 29, 1988

[51] Int. Cl.[4] ..... F04B 39/02

[52] U.S. Cl. ..... 417/420; 417/365; 417/366; 415/175

[58] Field of Search ..... 417/365, 366, 369, 370, 417/420; 415/110, 111, 175, 176

[56] References Cited

U.S. PATENT DOCUMENTS

| | | | |
|---|---|---|---|
| 3,420,184 | 1/1969 | Englesberg et al. | 417/420 |
| 4,013,384 | 3/1977 | Oikawa | 417/370 X |
| 4,047,847 | 9/1977 | Oikawa | 417/420 X |
| 4,080,112 | 3/1978 | Zimmermann | 417/420 |
| 4,722,661 | 2/1988 | Mizuno | 417/420 X |

*Primary Examiner*—Carlton R. Croyle
*Assistant Examiner*—Eugene L. Szczecina Jr.
*Attorney, Agent, or Firm*—D. W. Tibbott

[57] ABSTRACT

A centrifugal pump of the "sealless" type including a casing containing a pumping chamber, inlet and outlet, and an impeller mounted on a shaft supported by an independent bearing system. The impeller shaft is driven by a motor located outside of the casing through a set of magnets located on the opposite sides of the wall of the casing and magnetically interconnected together with the motor driving the magnets located on the outside of the casing and with magnets located on the inside of the casing being connected to and driving the pump impeller. The bearing system includes a lubricating system which in some cases will use the pumped fluid as a lubricant and coolant.

5 Claims, 1 Drawing Sheet

CENTRIFUGAL PUMP BEARING ARRANGEMENT

BACKGROUND OF THE INVENTION

This invention relates to a centrifugal pump and more particularly to a bearing arrangement for a type of centrifugal pump known as a "sealless pump".

A sealless pump is the type of centrifugal pump that has its impeller and bearing system isolated from the impeller driving mechanism by an isolating wall that seals the pumping mechanism from the surrounding environment and eliminates the necessity to use rotary seals to seal the pumped fluid against leaking along the shaft. This type of pump is particularly desirable when pumping corrosive or toxic fluids which are dangerous when allowed to leak. The driving mechanism is coupled to the pump impeller by an arrangement of magnets located on the opposite sides of the isolating wall which magnetically connects the torque of the driving mechanism to the impeller.

A sealless centrifugal pump must include an impeller bearing system which is independent of the motor driving bearings and therefore necessitates that the impeller bearing system carry the full load on the impeller including both radial and thrust forces. In the past, a designer of this type of pump generally used a closed impeller to reduce the thrust load on the bearing system to a manageable load. However, the use of a closed impeller is undesirable when pumping fluids contaminated with debris or other solid materials because the impeller is more easily clogged and is more difficult to clean than an open impeller.

SUMMARY OF THE INVENTION

An object of the invention is to provide a centrifugal pump of the sealless type having a semi-open impeller and a bearing system able to carry the load created by the semi-open impeller without premature failure.

Another object of the invention is to provide a centrifugal pump of the sealless type having a novel bearing lubrication system.

Another object of the invention is to provide a centrifugal pump of the sealless type having a bearing lubrication system using the pumped fluid as a lubricant and coolant for the bearing system.

DESCRIPTION OF PREFERRED EMBODIMENTS

Figure 2:
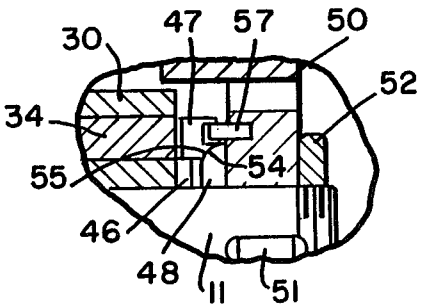
FIG. 2 is an enlarged portion of FIG. 1 showing the thrust bearing structure at the rear end of the impeller shaft.
Figure 1:
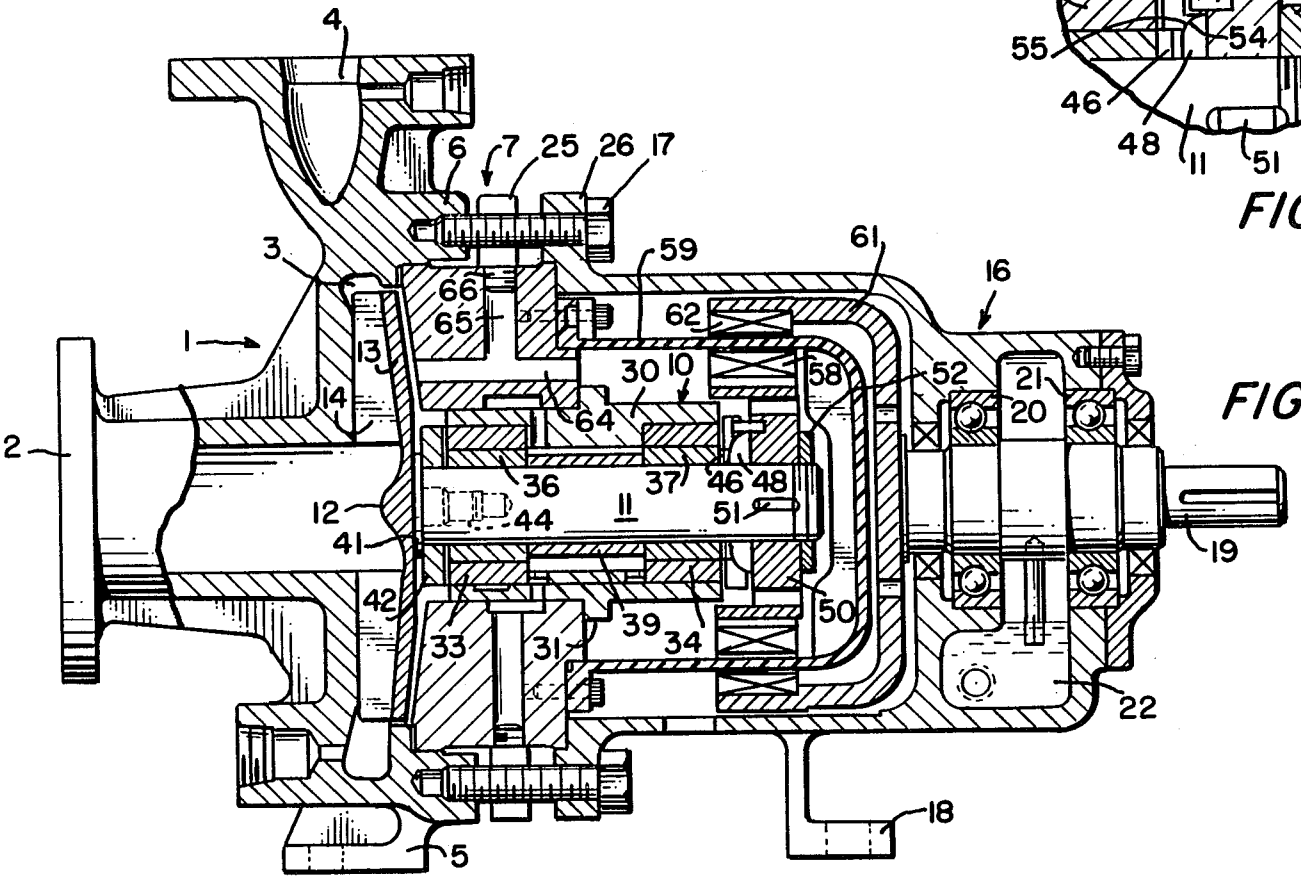
FIG. 1 is a vertical section of a centrifugal pump taken along the impeller axis incorporating the bearing system of the invention.

The sealless centrifugal pump shown in the drawings includes a pump casing 1 containing an axial inlet 2, a pumping chamber 3 and an outlet 4, all of which are interconnected by passages extending through the casing. The casing 1 also contains a mounting foot 5 and an annular flange 6 surrounding the pumping chamber 3. The annular flange 6 is adapted to receive a casing cover 7 circling a pump cartridge 10 containing a number of components including an axially extending shaft 11 carrying a semi-open pump impeller 12 rotating in the pump chamber 6 during pump operation. The cartridge 10 will be specifically described later. The semi-open impeller 12 includes a shroud 13 and a series of vanes 14 having one edge integral with the shroud 13.

A power frame 16 fits over the cartridge 10 and is attached to the casing 1 and casing cover 7 by a series of bolts 17 circling the outside of the flange 6. The power frame 16 further includes a mounting foot 18 adapted to support the pump in conjunction with the mounting foot 5 on the casing 1. A drive shaft 19 is rotatively mounted in the power frame 10 by a pair of axially spaced bearings 20 and 21 fixed in the frame 16 on the opposite sides of a bearing chamber 22 adapted to contain lubricant for the bearings 20 and 21. The outer end of the shaft 19 is adapted to be coupled to a driving motor (not shown) using a conventional coupling means.

The casing cover 7 is an annular member that slides into a recess in the casing 1 circling the pumping chamber 3 and has a lip 25 overlying the flange 6 with holes receiving the bolts 17. The annular lip 25 is sandwiched between the flange 6 and an annular flange 26 on the open end of the power frame 16 with the bolts 17 serving to hold both the casing cover 7 and the power frame 16 to the casing 1.

The cartridge body 30 fits into the casing cover 7 and has an annular step 31 seating against the outer face of the casing cover 7 controlling the distance that the cartridge body 30 extends into the casing cover 7. The cartridge body 30 contains recesses at both ends surrounding respective front and rear journal bearing bushings 33 and 34. The impeller shaft 11 extends through the bushings 33 and 34 and carries respective bearing sleeves 36 and 37 rotating in the bushings 33 and 34. The bearing sleeves 36 and 37 are slipped on the shaft 11 with a spacing sleeve 39 located therebetween.

The front end of the shaft 11 carries an outwardly extending flange 41 with a thrust collar 42 seating against the flange 41 and the forward end of the front bushing 33. The collar 42 controls the rearward axial movement of the shaft 11. The impeller 12 carries a threaded member 44 that threads into a threaded hole in the front end of the shaft 11 and seats against the shaft flange 41.

The rear end of the shaft 11 carries several items including a set of shims 46, a thrust bearing collar 47 and an aligning ring 48, all of which are slidably mounted on the shaft 11. A magnet holder 50 is keyed on the shaft 11 by a key 51 in a position engaging the rear face of the aligning ring 48 and is held in place by a nut 52 threaded on the rear end of the shaft 11. The nut 52 locks all of the rotating components of the cartridge 10 in place on the shaft 11 in the cartridge body 30 extending through the bearing bushings 33 and 34. The thickness of the set of shims 46 control the end play of the shaft 11 in the cartridge body 30.

The thrust collar 47 serves as a thrust bearing and rides on the rear end of the rear bushing 34 much like the front thrust collar 42 rides on the front end of the front bushing 33. However, the rear thrust collar 47 is loosely mounted on the shaft 11 and can move to eccentric positions relative to the shaft axis. The rear face 54 of the thrust collar 47 is beveled at an angle of 45 degrees relative to the axis of the shaft 11 and is engaged by the rounded front seat 55 of the aligning ring 48. The rounded face of the seat 55 follows a radius located in a plane that is parallel to and extends through the axis of the shaft 11.

The seat 55 and the beveled rear face 54 of the thrust collar 47 are dimensioned so the thrust collar 47 can move to an eccentric position if necessary for the front face of the thrust collar 47 to seat flat against the rear end of the rear bearing bushing 34. This arrangement allows the thrust collar 47 to move to a position that corrects for any misalignment between the shaft 11 and journal bearings comprising the sleeves 36 and 37 and bushings 33 and 34. The thrust collar 47 is keyed to rotate with the magnet holder 50 by several pins 57 that are fixed to the rear face of the thrust collar 47 and extend rearwardly and loosely into corresponding holes placed in the front face of the magnet holder. The holes are large enough to provide the pins 57 with sufficient play to allow the thrust collar 47 to move a sufficient distance relative to the shaft axis for adjusting the alignment of the thrust collar 47 on the rear end of the adjacent bearing bushing 34.

The periphery of the magnet holder 50 carries a series of magnets 58 which rotate closely about the interior of a relatively thin can-shaped shell 59 which fits over the magnet holder 50 and the other parts of the cartridge 10. The power frame 16 contains an outer magnet holder 61 attached to and rotating with the drive shaft 19 around the can-shaped shell 59 in close proximity thereto. The outer magnet holder 61 carries a series of magnets 62 spaced around its interior which are magnetically linked to the magnets 58 on the inner magnet holder 50 for transmitting torque from the outer magnet holder 61 to the pump impeller shaft 11. Driving a pump impeller using magnets in this manner is well known in the art of sealless pumps.

The casing cover 7 contains a fluid passage 64 extending from its front face to its rear face for conducting the pumped fluid from the pumping chamber 3 into the space containing the magnet holder 50. This fluid flows to the thrust bearing including the thrust collar 47, passing through such thrust bearing and then forwardly along the shaft 11 through the journal bearings including the bearing bushings 33 and 34 and exits from the thrust bearing 42 on the shaft 11 adjacent the impeller 12. Such fluid serves to lubricate and cool such bearings. Using the pumped fluid as a lubricant is possible when the nature of the pumped fluid enables it to serve as a lubricant.

In the event the pumped fluid cannot serve as a lubricant, such as when it is too dirty, the forward end of the passage 64 can be closed by a threaded plug and lubricating fluid is introduced from the outside through the branch passage 65 running into the passage 64 and shown as blocked by the threaded plug 66. Normally, this lubricating fluid is pumped fluid that has been passed through a filter system for cleaning it.

In the past, designers of sealless pumps have introduced the lubricating fluid into the bearing system midway between the journal bearings causing the lubricating fluid to flow in both directions along the shaft 11. It has been found that this type of lubricating system will not work with this type of pump under the conditions intended for the pump disclosed herein. The pressure of the lubricating fluid exiting from the front end of the shaft 11 is at such a high pressure that it places an undue load on the impeller 12 causing the bearings to quickly fail. This high thrust load could be reduced by making the impeller 12 a closed impeller, which is the step taken by previous designers of this type of pump facing the same problems. However, closed impellers have other problems such as being difficult to clean.

It should be mentioned that the bearing surfaces disclosed herein are made of silicon carbide which is a very hard surface and is necessary to carry the loads in this pump design. Nevertheless, such bearings could not survive until the invention of the present system wherein the lubricating fluid is passed inwardly through the thrust bearing 47 and then forwardly along the shaft 11 through the journal bearings and exiting from the thrust bearing bearing collar 42 adjacent the impeller 12.

While only one embodiment of this invention is shown and described in detail, this invention is not limited merely to the specifically described embodiment, but contemplates other embodiments and variations utilizing the concepts and teachings of this invention.

I claim:

1. Centrifugal pump of the sealless type comprising: a housing containing a pumping chamber, a pump inlet passage extending from an inlet in the housing and opening into the pumping chamber and a pump outlet passage running from the pumping chamber to an outlet in the housing; a shaft mounted in said housing for rotation; a pump impeller attached to the forward end of the shaft for rotation with the shaft in the pumping chamber and a magnet holder attached to the rear end of the shaft carrying a first magnetic means adapted to be magnetically coupled to a second magnetic means rotated by a rotary driving device such as an electric motor, said shaft being mounted in at least two bearings spaced from each other along the length of the shaft and located between the impeller and the magnet holder, a shell surrounding the shaft bearings, and magnet holder to seal the pump from the exterior and prevent the pumped fluid from leaking, said shell being located between the two magnetic means and being able to transmit magnetic forces between the two magnetic means for magnetically coupling said two magnetic means together, said housing containing a passage for conducting lubricating fluid to the part of the shaft located rearward of the bearings relative to the impeller and forward of the magnet holder, and means for feeding the lubricating fluid forwardly along the length of said shaft through both bearings before exiting from the bearings adjacent the impeller whereby the pressure on the lubricating fluid is automatically lowered by passage through the bearings causing it to be at a substantially reduced pressure when exiting from the bearings adjacent the impeller, thereby reducing the pressure of said lubricating fluid applied to the impeller as it exits from said bearings.

2. The pump of claim 1 including a thrust bearing located on the shaft rearwardly of the bearings and forwardly of the magnet holder and within the shell with the means for feeding the lubricating fluid being arranged to feed the lubricating fluid through the thrust bearing first before such fluid is fed to the other bearings so that the pressure on such fluid is reduced by passing in series through the thrust bearing and then through the other bearings mounted along the impeller shaft.

3. The pump of claim 1 wherein the lubricating fluid is drawn from the fluid being pumped.

4. The pump of claim 1 wherein the lubricating fluid is separate from the fluid being pumped.

5. The pump of claim 2 wherein the thrust bearing is self-aligning to insure full engagement between the engaging parts of the bearing surrounding the periphery of the shaft.

* * * * *